United States Patent [19]

Ferrari

[11] Patent Number: 4,508,225

[45] Date of Patent: Apr. 2, 1985

[54] CONTAINER DISPLAY PACKAGE

[75] Inventor: Luigi M. Ferrari, Douglaston Hills, N.Y.

[73] Assignee: Del Laboratories, Inc., Del.

[21] Appl. No.: 559,940

[22] Filed: Dec. 9, 1983

[51] Int. Cl.[3] ..... B65D 73/00

[52] U.S. Cl. ..... 206/461; 206/465; 206/471; 206/477; 206/807

[58] Field of Search ..... 206/461, 462, 465, 471, 206/477, 480, 806, 807, 338, 230, 231; 220/902

[56] References Cited

U.S. PATENT DOCUMENTS

| | | | |
|---|---|---|---|
| 3,404,774 | 10/1968 | Levine | 206/464 |
| 3,512,636 | 5/1970 | Davidson | 206/462 |
| 3,710,930 | 1/1973 | Owdom | 220/902 |
| 3,809,226 | 5/1974 | Ferrari | 206/461 |
| 3,968,914 | 7/1976 | Goncalves | 206/149 |
| 3,978,761 | 9/1976 | Sosinski | 206/338 |
| 4,328,894 | 5/1982 | Edell | 206/461 |
| 4,331,237 | 5/1982 | Edell | 206/471 |

*Primary Examiner*—William T. Dixson, Jr.
*Assistant Examiner*—Brenda J. Ehrhardt
*Attorney, Agent, or Firm*—Kirschstein, Kirschstein, Ottinger & Israel

[57] ABSTRACT

A display package for a container including a receptacle having an open end and a cap mounted on the open end and closing the same, particularly for a container containing a cosmetic substance, includes a backing card, a first mounting part secured to the backing part and embracing that end of the receptacle which is remote from the cap in a cup-like fashion to prevent movement of the container relative to the backing card in one axial direction as well as radially, and a second mounting part which embraces the container at the elevation of the cap and has a locking surface which engages a retaining surface of the cap that is situated a different distance from the axis of the container than the remainder of the periphery of the cap. The retaining surface may be flat and form a recessed formation in the cap, in which case the locking surface interferes with turning of the cap relative to the receptacle about the central axis of the container. However, the retaining surface may also be provided on an outwardly projecting circumferentially extending collar of the cap, in which event the locking surface interferes with movement of the cap relative to the receptacle in the other axial direction of the container. The locking surface may terminate in a knife edge at its region close to the cap to obtain deformation of the second mounting part or of the cap during attempted removal of the cap from the receptacle while mounted on the backing card. The mounting parts are interconnected by lateral parts.

8 Claims, 9 Drawing Figures

CONTAINER DISPLAY PACKAGE

The present invention relates to packaging of articles to be sold in general, and more particularly to display packages for cosmetic substance containers, such as fingernail polish bottles or lipstick cartridges.

Such containers are known in a variety of shapes. However, what is common to them is that each of them includes a receptacle which contains the cosmetic or other substance and has an open end, and a closure, especially a cap, for such open end. Such containers are currently being sold predominantly if not exclusively in department stores, drug stores and similar establishments in an off-the-shelf manner, rather than over the counter. Since such containers are usually quite small in size, they present a temptation to would-be shoplifters if they are on display by themselves. Therefore, it was proposed to attach such containers to display cards, such as by blister covers or by clips. Then, the size of the item on sale is primarily determined by the size of the backing card, rather than by the size of the container, so that it is more difficult to unnoticeably conceal. However, the use of the backing card has also other advantages, for instance, that the article in the display package is presented in a very attractive way, and that the package can be suspended from a peg or the like, thus saving storage space, keeping a neat display, and maintaining the items in a position in which they appear in the most favorable light.

Various ways of attaching articles on display for sale to an underlying structure are disclosed in U.S. Pat. Nos. 1,949,792; 3,139,182; 3,404,774; 3,416,656; 3,437,194; 3,512,636; 3,695,452; 3,809,226; 3,924,736; 4,037,717; 4,328,894; 4,331,237; and in the British Pat. No. 1,325,068. So, for instance, U.S. Pat. Nos. 3,404,774 and 3,809,226 disclose blister packages for cosmetic articles wherein the blister cover that attaches the article to the backing card is deliberately so designed as to engage only the receptacle of the container, and not the cover, so as to securely hold the container in position on the backing card, and yet to permit removal of the cap from the container, so that the prospective customer can remove the cap and sample the substance contained in the receptacle, when the receptacle contains a liquid, such as fingernail polish, or to hold only the cover on the backing card so as to permit removal of the receptacle for a similar purpose, when the receptacle contains a substantially pasty substance, such as lip color or gloss or the like. The reason for this was that, without enabling the customer to sample the substance, the sales would suffer since customers would not buy the article without being able to test it for color and compatibility with complexion.

This approach may not have been too hygienic but, in view of the then prevailing custom, it was acceptable both to the vendors and the customers. However, in view of the recent instances of tampering with the contents of containers available in a readily accessible manner on shelves of drug stores or the like, this approach is no longer acceptable.

On the other hand, U.S. Pat. No. 4,328,894 discloses a package for articles of the type here under consideration, in which the article is mounted on the backing card by means of a clip that embraces the article at the region of joinder of the cap with the receptacle and engages from opposite directions respective shoulders provided on the receptacle and on the cap. However, because of the only short distance between the shoulders, the entire article or container can be so maneuvered as to remove the same from underneath the clip, thus not only enabling tampering but also facilitating pilfering.

SUMMARY OF THE INVENTION

Accordingly, it is a general object of the present invention to avoid the disadvantages of the prior art.

More particularly, it is an object of the present invention to provide a display package for containers, especially such containing cosmetic preparations, which does not possess the disadvantages of the conventional display packages of this type.

Still another object of the present invention is so to construct the display package of the type here under consideration as to prevent removal of the container or of any part thereof from the package.

It is yet another object of the present invention so to design the display package of the above type as to present the container in the most attractive way, and yet to prevent tampering with the contents thereof.

A concomitant object of the present invention is to develop a display package of the above type which is simple in construction, easy to manufacture by resorting to existing manufacturing techniques and equipment, inexpensive, and reliable in use for accomplishing the above-enumerated objects nevertheless.

In pursuance of these objects and others which will become apparent hereafter, one feature of the present invention resides in a display package for a container having a central axis and including a receptacle having axially spaced closed and open ends, and a cap removably mounted on the open end of the receptacle to close the same and having at a region of its periphery which is close to the receptacle at least one retaining formation that is spaced a different radial direction from the central axis than the remainder of the periphery and moves in a predetermined trajectory during attempted removal of the cap from the receptacle. This display package according to the invention comprises a substantially sheet-shaped backing element, and means for mounting the container in a predetermined position on the backing element, such mounting means including a substantially cup-shaped first mounting part secured to the backing element and so embracing and accommodating the closed end of the receptacle as to prevent movement of the container radially and in one of its axial directions in which the closed end would lead, and a substantially annular second mounting part secured to the backing element at a distance from the first mounting part to embrace the cap and having a locking surface that extends into the predetermined trajectory of movement of the formation of the cap to prevent unnoticeable removal of the cap from the receptacle while the container is mounted on the backing element A particular advantage of the display package as described so far is that, because of the relatively large distance between the portions of the container that are engaged by the mounting means, it is impossible to remove the container from the package without either damaging or destroying the package, or damaging the container and particularly the cap thereof, thus leaving traces of such attempted removal. Moreover, the package of the present invention also prevents relative movement between the cap and the receptacle in a manner dissociating one from the other for removal from the package, without leaving behind tell-tale signs of such attempted removal in form of damage to either the package or the cap, or both.

It is particularly advantageous when the mounting means further includes two lateral parts extending along the backing element between the first and second mounting parts to bound an opening through which the container can be unimpededly observed and integral with the first and second mounting parts to form a unitary mounting element therewith. The lateral parts then give the mounting element a considerable stability and rigidity, without interfering with the observation of the container.

Advantageously, the backing element has a plurality of apertures, and the first and second mounting parts have respective mounting projections extending through the apertures and engaging the backing element around the latter at the opposite side of the backing element from the first and second mounting parts. This is a particularly simple and effective way of mounting the mounting parts or mounting element on the backing element.

When the present invention is to be used with a container whose cap has a plurality of circumferentially distributed recesses of which any selected one can constitute the retaining formation, and is connected to the open end by a meshing threaded connection such that the formation conducts movement in its trajectory of movement during the removal of the cap both in the other axial direction and in the circumferential direction, each recess being bounded by a retaining surface, it is proposed, in accordance with an advantageous aspect of the present invention to so construct the second mounting part that the locking surface spans the selected recess and is juxtaposed with the respective retaining surface bounding such selected recess to interfere at least with the movement of the retaining surface in the circumferential direction. In this context, it is particularly advantageous when the locking surface is multifaceted to also span additional ones of the recesses and be juxtaposed with additional ones of the retaining surfaces.

On the other hand, the display package can also be advantageously used for packaging a container whose cap has at least one projection extending radially outwardly from the periphery of the cap and constituting the retaining formation. Then, the second mounting part has, according to another facet of the present invention, a portion extending radially inwardly toward the cap behind the projection as considered in the other axial direction and carrying the locking surface on its zone facing in the one axial direction to interfere with the movement of the retaining formation relative to the receptacle and the mounting means in the other axial direction. Advantageously, the aforementioned projection circumferentially completely surrounds the periphery of the cap to form a collar thereon, and the portion of the second part that carries the locking surface extends along a substantially U-shaped course in juxtaposition with the collar. In this construction, the container can be turned as an entity about its central axis so as to enable observation of either the label on the container, or the contents of the container through a portion of the container that is not covered by the label.

It is further advantageous when the locking surface extends at an acute angle relative to the central axis to form a knife edge at a region thereof that is juxtaposed with the retaining surface. Such knife edge will then either bend or break, or score the cap, if it is attempted to remove the latter.

The novel features which are considered as characteristic of the invention are set forth in particular in the appended claims. The improved display package itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
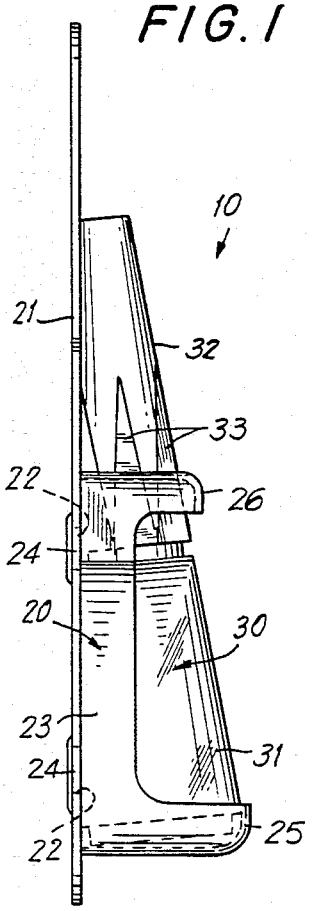
FIG. 1 is a side elevational view of a display package supporting a container with a cap having a plurality of circumferentially distributed recesses.
Figure 2:
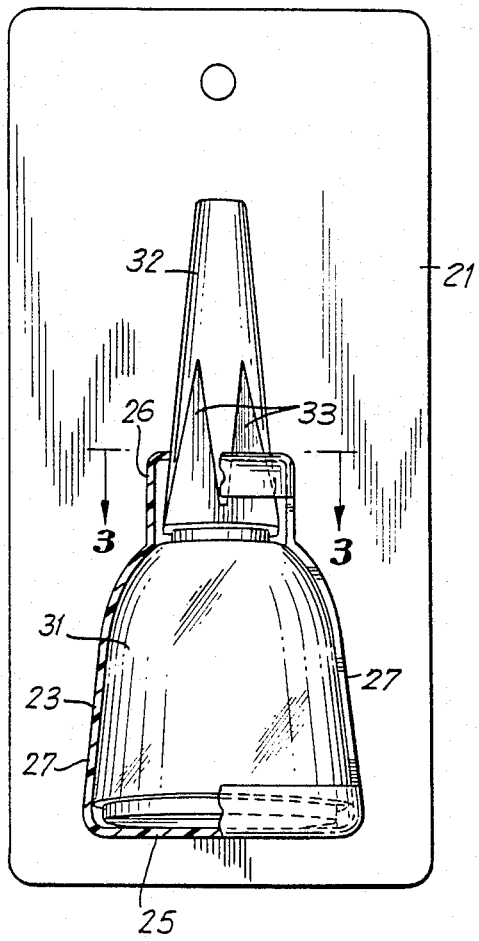
FIG. 2 is a partially sectioned front elevational view of the display package of FIG. 1.

Referring now to the drawing in detail, and first to FIG. 1 thereof, it may be seen that the reference numeral 10 has been used therein to identify a display assembly constructed in accordance with the present invention, in its entirety. The display assembly 10 includes, as its main components, a packaging arrangement 20 and a container 30. The container 30 has the shape usually associated with fingernail treatment substances, such as nail polish or the like, in its form depicted in the drawing. However, it is to be understood that the present invention is not so restricted. Rather, while the present invention will be explained by way of examples in the manner in which it is being used in conjunction with nail polish containers 30, it will be appreciated that the principles of the present invention can just as easily be embodied in display assemblies containing other types of containers, such as those accommodating lipstick, for example.

The container 30 is basically of a bipartite construction, containing a receptacle 31 and a closure or cap 32 for the latter. As customary, the cap 32 is mounted on a neck portion of the receptacle 31 for relative movement between the former and the latter between a closed and an open position of the cap 32 relative to the receptacle 31. Usually, such mounting is achieved by means of external thread on the neck portion of the receptacle 31 and a corresponding internal thread in the cap 32, and this approach has also been chosen for the container 30 shown in the drawing, even though the interengaging threads have not been shown because of their conventionality. However, if the substance contained in the container 30 is not volatile, so that it is not necessary to assure air-tight closure of the receptacle 31 by the cap 32, such positive connection can be omitted and the cap 32 may be held on the receptacle 31 merely by friction or interference fit, as is customary, for instance, in lipstick containers.

The cap 32 is shown to taper or converge in the direction away from the receptacle 31 and is shown in FIGS. 1 to 6 to have a plurality of flat surfaces 33 which penetrate inwardly of the otherwise generally frusto-conical outline of the cap 32 in substantial parallelism with a tangent to the imaginary outline in the respective cross section of the cap 32. However, the plane of the respective flat surface 33 includes a smaller acute angle with the axis of the cap than the generatrix of the imaginary frusto-conical outline, so that the flat surfaces 33 widen from a point in direction toward the receptacle 31. Yet, the surfaces 33 need not necessarily be flat; it is sufficient for the purposes of the present invention that they inwardly deviate from the otherwise circular outline of the cap at the cross sections of interest. So, for instance, the surfaces 33 could be more or less convex, thus bounding respective depressions in the periphery of the cap 32. The as-if missing regions of the cap 32 which are inwardly delimited by the surfaces 33 will hereafter be referred-to as recesses, or recessed formations, considering the fact that at these regions the cap 32 is recessed from its generally frusto-conical basic outline.

The packaging arrangement 20 includes a backing element or card 21 which is provided with apertures 22, and a mounting sheath 23 which is mounted on the card 21 by means or mounting portions 24 which pass through the apertures 22 and have enlarged head portions that engage the card 21 around the apertures 22 at the opposite side of the card 21 from the remainder of the sheath 23. The sheath 23 bounds a pocket for accommodating the container 30 and particularly the receptacle 31 thereof, but also a portion of the cap 32. To hold the container in place on the card 21, the sheath 23 has a bottom portion 25 which embraces the bottom region of the receptacle 31 and on which the latter rests, and a top portion 26 which embraces the cap 32. As illustrated, the sheath 23 also has connecting webs 27 which interconnect the bottom and top portions 25 and 26 of the sheath 23 and hence rigidify the latter. The connecting webs 27 are situated close to the card 21 and extend substantially normal thereto. The bottom and top portions 25 and 26 and the connecting webs 27 together bound a cutout in the sheath 23, through which the container 31 can be observed. While the sheath 23 may be, and usually is, made of a clear or transparent plastic, the provision of the cutout is still beneficial in alleviating any doubts which a prospective purchaser may entertain with respect to the color of the contents of the container 30 and the effect of the transparent plastic material of the sheath 23 on the perceived color. Also, the label which is usually affixed to the receptacle 31 can be seen and clearly read through the cutout.

Figure 3:
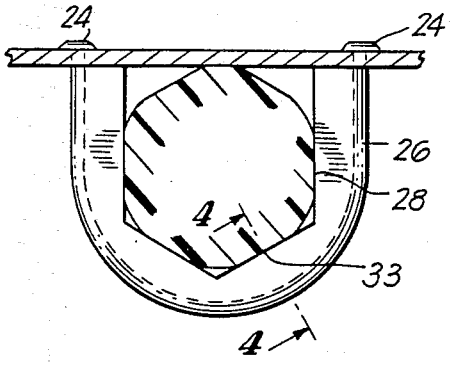
FIG. 3 is an enlarged cross-sectional view taken on line 3—3 of FIG. 2.
Figure 4:
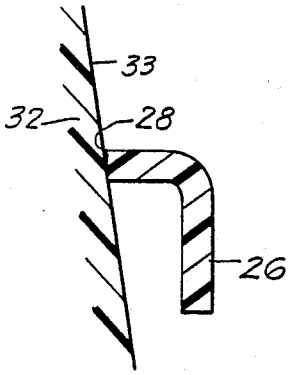
FIG. 4 is a further enlarged sectional view taken on line 4—4 of FIG. 3.

To avoid tampering with the contents of the container 30 while it is supported on the card 21 by the sheath 23, without leaving evidence of such tampering, it is proposed according to the present invention, so to construct the sheath 23 and particularly the top portion 26 as to prevent removal of the cap 32 from the receptacle 31, unless damaged. As shown particularly in FIG. 3, this may be achieved by providing the top portion 26 of the sheath 23 with a locking surface 28 which is juxtaposed with, and engages, at least one of the surfaces 33 of the cap 32. In other words, the region of the top portion 26 of the sheath 23 which carries the locking surface 28 extends into and across the aforementioned recess of the cap 32 of the container 30 so long as the sheath 23 connects the latter to the card 21. As shown in FIG. 3, however, the locking surface 28 is advantageously polygonal so that the associated regions of the top portion 26 of the sheath 23 actually extend into and across more than one (as shown, four) of such recesses, and the locking surface 28 engages a corresponding number of the surfaces 33 of the cap 32. As shown in FIG. 4, the locking surface 28 of the top portion 26 is in line contact with the respective surface 33 of the cap 32 so that, if it were attempted to remove the cap 32 from the receptacle 31, either the surface 28 or its edge would scratch or score the cap 32, or the top portion 26 of the sheath 23 would be permanently deformed or break at the locking surface 28, depending on relative hardness, pliability and brittleness of the cap 32 and the sheath 23. In any event, the damage will be apparent and hence serve as evidence of tampering. Of course, if both the cap 32 and the sheath 23 were hard enough that no damage thereto could occur, then they obviously would also be hard enough to prevent turning of the cap 32 in the opening bounded by the locking surface 28, or its extraction through the opening.

Figure 5:
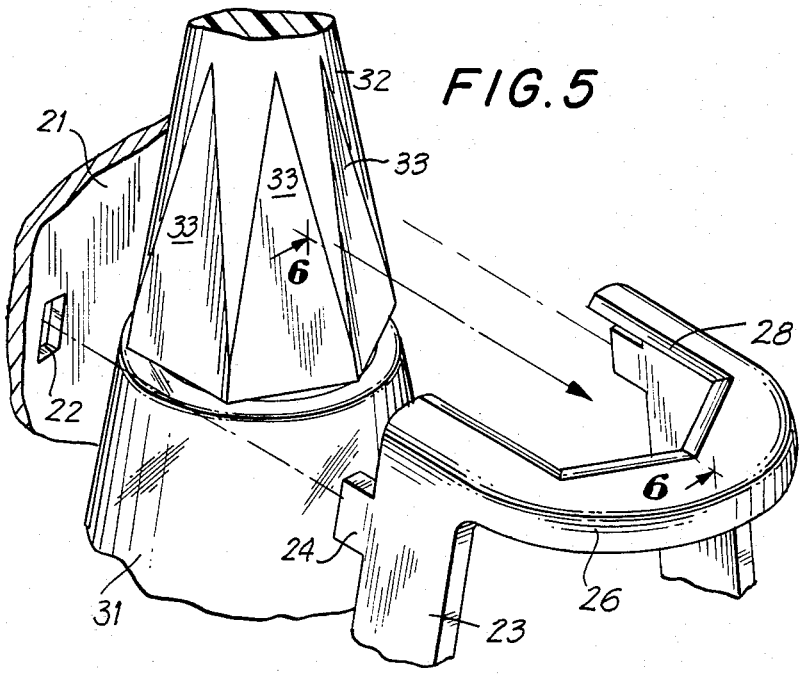
FIG. 5 is a perspective enlarged view of a region of the container and display package at the elevation of the cap, showing a modification of the display package, prior to assembly.
Figure 6:
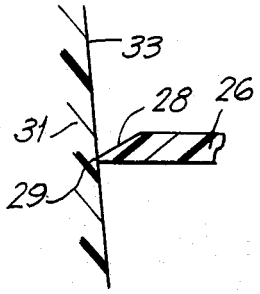
FIG. 6 is a sectional view taken along line 6—6 of FIG. 5 but after assembly.

FIGS. 5 and 6 illustrate a modification of the approach discussed above, so that similar reference numerals as before are being used to identify the same or similar parts. This time, however, the locking surface 28, rather than extending substantially normal to the top and bottom surfaces of the top portion 26 of the sheath 23, extends at an acute angle to the bottom surface of the top portion 26, thus delimiting a knife edge 29 at the zone of contact with the surface 33 of the cap 32, as illustrated in FIG. 6. By giving this region a wedge-shaped configuration that terminates in the knife edge 29, the likelihood and extent of damage to either the cap 32 or the top portion 26 of the sheath 23 are increased.

Figure 7:
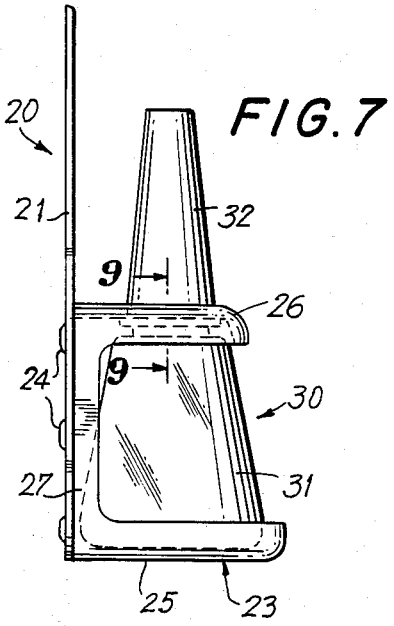
FIG. 7 is a view similar to FIG. 1 but wherein the cap is provided with a retaining collar at its periphery close to the receptacle.
Figure 8:
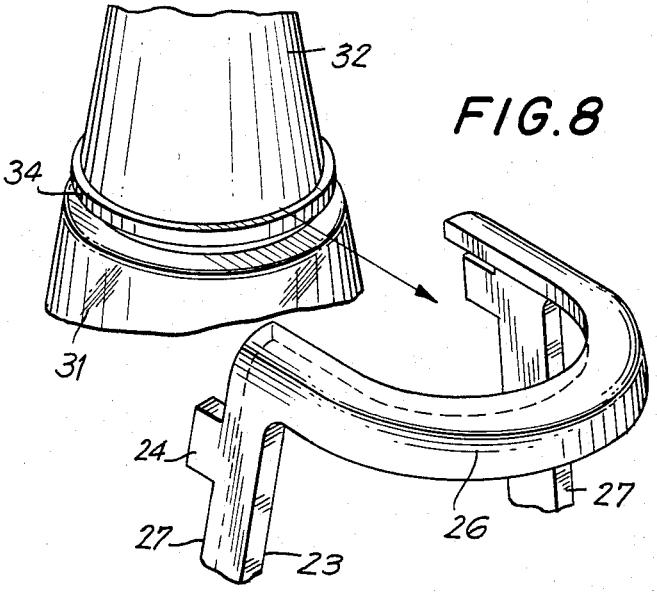
FIG. 8 is a view similar to FIG. 5 but of the display package and container as depicted in FIG. 7.
Figure 9:
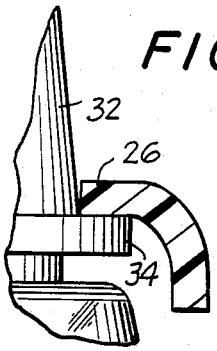
FIG. 9 is a fragmentary sectional view taken on line 9—9 of FIG. 8.

FIGS. 7 to 9 depict a modified version of the display assembly 10 of the present invention, where again the same reference numerals as above have been used to designate the same or corresponding parts. This time, however, the cap 32, which may be frusto-conical but need not be, and which may be smooth as shown or include the recesses described above that are delimited by the surfaces 33, is provided, at its portion juxtaposed with and located below the top portion 26 in the assembled condition of the assembly 10, with a collar or similar projecting formation 34 that extends either continuously as shown, or with limited interruptions, around the entire periphery of the cap 32. As shown particularly in FIG. 9, this collar 34 has a diameter exceeding that of the opening for the cap 32 bounded by the top portion 26 of the sheath 23 which is constructed as a flange at this region, and is situated below this flange, so that separation of the cap 32 from the receptacle 31, which rests on the bottom portion 25 of the sheath 23, is impossible without damaging either the sheath 23 or the container 30. Thus, even in this instance, evidence of tampering will be visible, enabling the prospective purchaser to refuse to buy any assembly 10 that has been damaged.

Obviously, the expedients above will prevent prospective purchasers from trying the contents of the container 30 for color shade and compatibility with complexion or the like. Yet, by giving assurance that the contents of the container 30 has not been tampered with, they go a long way toward making the product attractive to the prospective purchasers. Moreover, since at least one part of the container 30, such as the receptacle 31 of the nail polish container 30, or the cap of a lipstick container, may be and often is transparent, the color of the contents of the container 30 can be observed through the cutout in the sheath 23 and the receptacle 31, or through the cap 32, thus alleviating any doubts which the prospective purchaser may have with respect to the actual color and shade of the contents of the container 30.

It will be understood that each of the elements described above, or two or more together, may also find a useful application in other types of arrangements differing from the type described above.

While the invention has been illustrated and described as embodied in a display assembly for containers with fingernail treatment substances, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A display package for a container having a central axis and including a receptacle having axially spaced closed and open ends, and a cap removably mounted on the open end to close the same and having at a region of its periphery which is close to the receptacle at least one retaining formation that is spaced a different radial distance from the central axis than the remainder of the periphery and moves in a predetermined trajectory during attempted removal of the cap from the receptacle, comprising:

a substantially sheet-shaped backing element; and means for mounting the container in a predetermined position on the backing element, including a substantially cup-shaped first mounting part secured to said backing element and so embracing and accommodating the closed end of the receptacle as to prevent movement of the container radially and in one of its axial directions in which the closed end would lead, and a substantially annular second mounting part secured to said backing element at a distance from said first mounting part to embrace the cap and having a locking surface that extends into the predetermined trajectory of movement of the formation of the cap, said locking surface and the formation together preventing unnoticeable removal of the cap from the receptacle while the container is mounted on said backing element.

2. The display package as defined in claim 1, wherein said mounting means further includes two lateral parts extending along said backing element between said first and second mounting parts to bound an opening through which the container can be unimpededly observed and integral with said first and second mounting parts to form a unitary mounting element therewith.

3. The display package as defined in claim 1, wherein said backing element has a plurality of apertures, and said first and second mounting parts have respective mounting projections extending through said apertures and engaging said backing element around the latter at the opposite side of said backing element from said first and second mounting parts.

4. The display package as defined in claim 1 for use with a container whose cap has a plurality of circumferentially distributed recesses of which any selected one can constitute the retaining formation, and is connected to the open end by a meshing threaded connection such that the formation conducts movement in its trajectory of movement during the removal of the cap both in the other axial direction and in the circumferential direction, each recess being bounded by a retaining surface, wherein said locking surface spans the selected recess and is juxtaposed with the respective retaining surface bounding such selected recess to interfere at least with the movement of the retaining surface in the circumferential direction.

5. The display package as defined in claim 4, wherein said locking surface is multifaceted to also span additional ones of the recesses and be juxtaposed with additional ones of the retaining surfaces.

6. The display package as defined in claim 1 for use with a container whose cap has at least one projection extending radially outwardly from the periphery of the cap and constituting the retaining formation, wherein said second mounting part has a portion extending radially inwardly toward the cap behind the projection as considered in the other axial direction and carrying said locking surface on its zone facing in said one axial direction to interfere with the movement of the retaining formation relative to the receptacle and said mounting means in said other axial direction.

7. The display package as defined in claim 6, wherein said projection circumferentially completely surrounds the periphery of the cap to form a collar thereon, and said portion of said second part extends along a substantially U-shaped course in juxtaposition with the collar.

8. The display package as defined in claim 1, wherein said locking surface extends at an acute angle relative to the central axis to form a knife edge at a region thereof that is juxtaposed with the retaining surface.

* * * * *